United States Patent [19]

Stenberg

[11] 4,050,216

[45] Sept. 27, 1977

[54] METHOD OF PROVIDING A PACKAGE WITH A HANDLE

[75] Inventor: Folke Gustav Adolf Stenberg, Kungalv, Sweden

[73] Assignee: Iwema Forpacknings AB, Goteborg, Sweden

[21] Appl. No.: 495,795

[22] Filed: Aug. 8, 1974

Related U.S. Application Data

[63] Continuation of Ser. No. 238,235, March 27, 1972, abandoned.

[51] Int. Cl.[2] ..... B65B 61/14; B65B 53/02

[52] U.S. Cl. ..... 53/14; 53/30 S

[58] Field of Search ..... 53/14, 30 S, 48, 49, 53/134, 184 S; 206/432, 497; 229/DIG. 12

[56] References Cited

U.S. PATENT DOCUMENTS

| | | | |
|---|---|---|---|
| 2,359,298 | 10/1944 | Brogden | 53/48 X |
| 3,112,856 | 12/1963 | MacIntosh et al. | 229/52 B |
| 3,239,991 | 3/1966 | Copping | 53/30 S |
| 3,302,784 | 2/1967 | Copping | 206/432 X |
| 3,545,165 | 12/1970 | Greenwell | 53/48 X |
| 3,557,947 | 1/1971 | Greenwell | 206/432 |

FOREIGN PATENT DOCUMENTS

| | | | |
|---|---|---|---|
| 1,483,035 | 6/1965 | France | 229/52 B |

*Primary Examiner*—Robert Louis Spruill
*Attorney, Agent, or Firm*—Harness, Dickey & Pierce

[57] ABSTRACT

A method is disclosed for making a package comprising a shrinking film surrounding a number of articles arranged in a package pattern and presenting on its top surface, which surface comprises at least two layers of said film to reinforce said surface, a carrying handle made wholly or partly from the package material proper, said handle being delimited by two cuts formed in the lengthwise direction in said reinforced top surface of said package, said handle being thus integral with the rest of the film at its ends only.

5 Claims, 10 Drawing Figures

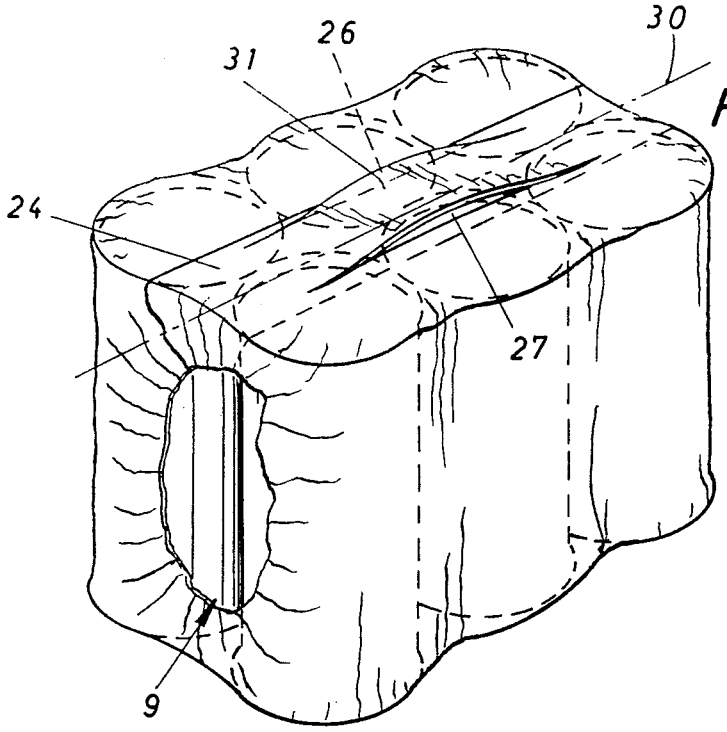
Fig.3
Fig.4
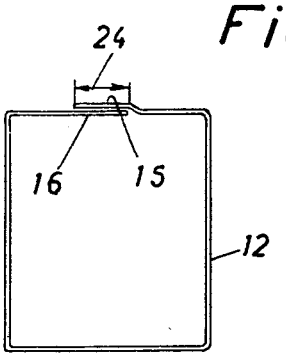
Fig.5
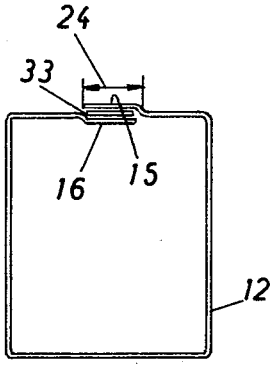
Fig.6
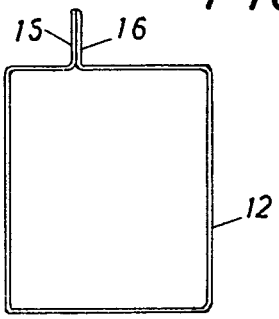
Fig.7
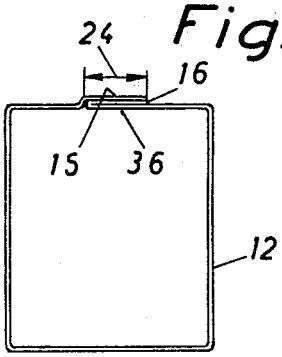

METHOD OF PROVIDING A PACKAGE WITH A HANDLE

This is a continuation of application Ser. No. 238,235, filed Mar. 27, 1972 and now abandoned.

BACKGROUND OF THE INVENTION

The present invention relates to packages of the kind being provided with a handle and consisting of a film of plastics surrounding a number of articles arranged in a packaging pattern. The film of plastics used for this purpose generally is a so-called shrinking film, for instance of polyethylene type. The purpose of the invention is to simplify the manufacture of packages of the kind having on their top surface an elongate upper section comprising at least two layers of the film while at the same time to form the handle from the packaging material proper, i.e. from the shrinking film in a simple manner to render the package easy and convenient to carry.

SUMMARY OF THE INVENTION

The invention is characterised in that the elongate reinforced section of the package are made two parallel cuts in the film, extending in the longitudinal direction of said reinforced package section on either side of the longitudinal centre line of said section, the carrying handle being formed by the portion situated between said cuts and being integral with the rest of the film at its ends.

The invention also concerns a method for the manufacture of packages of this kind, wherein a film of plastics, preferably a so-called shrinking film, is being wrapped around a number of packaging articles arranged in any desired packing pattern in a manner permitting the longitudinal side edge portions of the film of plastics to overlap and to be interconnected in this area, preferably by means of heat.

The characteristic feature of the method in accordance with the invention is the provision of two lengthwise extending cuts on the elongate, reinforced section of the film of plastics thus formed, said cuts running in parallel with, or on either side of the reinforced section whereby a strip is formed the ends of which are integral with the rest of the film of plastics and which strip is intended to be used as a carrying handle when the package is carried.

Finally, the invention also relates to a machine for manufacturing packages designed as indicated above in accordance with the method defined.

BRIEF DESCRIPTION OF THE DRAWINGS

The invention will be described more in detail in the following with reference to the accompanying, partly diagrammatical drawings, wherein FIG. 3 is a perspective view as seen obliquely from above of a package formed in accordance with the invention and containing six cans, such as beer cans, FIGS. 4, 5, 6, and 7 are vertical cross sections through packages manufactured in accordance with various methods of procedure according to the invention.

DETAILED DESCRIPTION OF A PREFERRED EMBODIMENT

Figure 1:
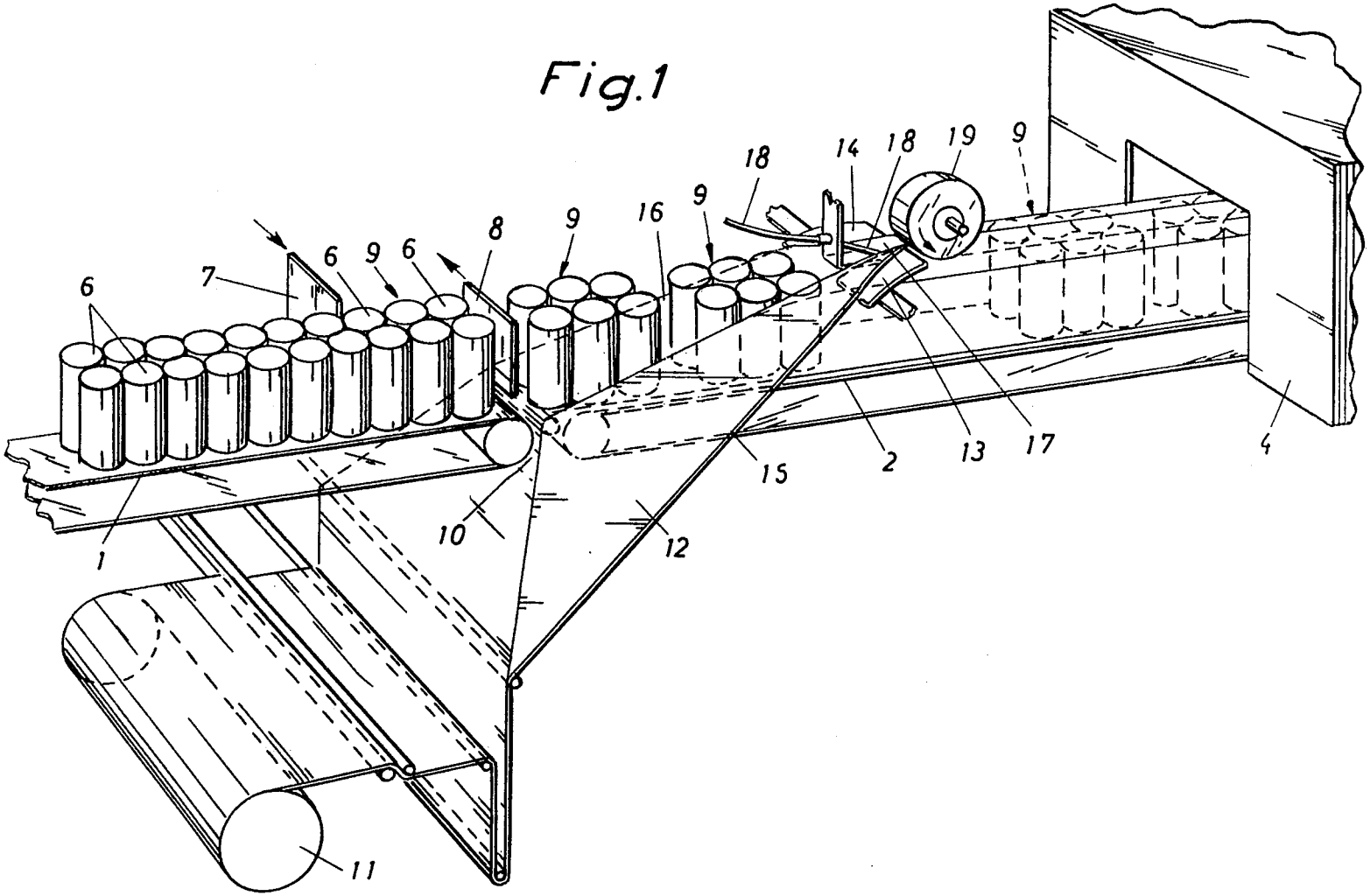
FIG. 1 is a perspective view of the front portion of the packaging machine in accordance with the invention.
Figure 2:
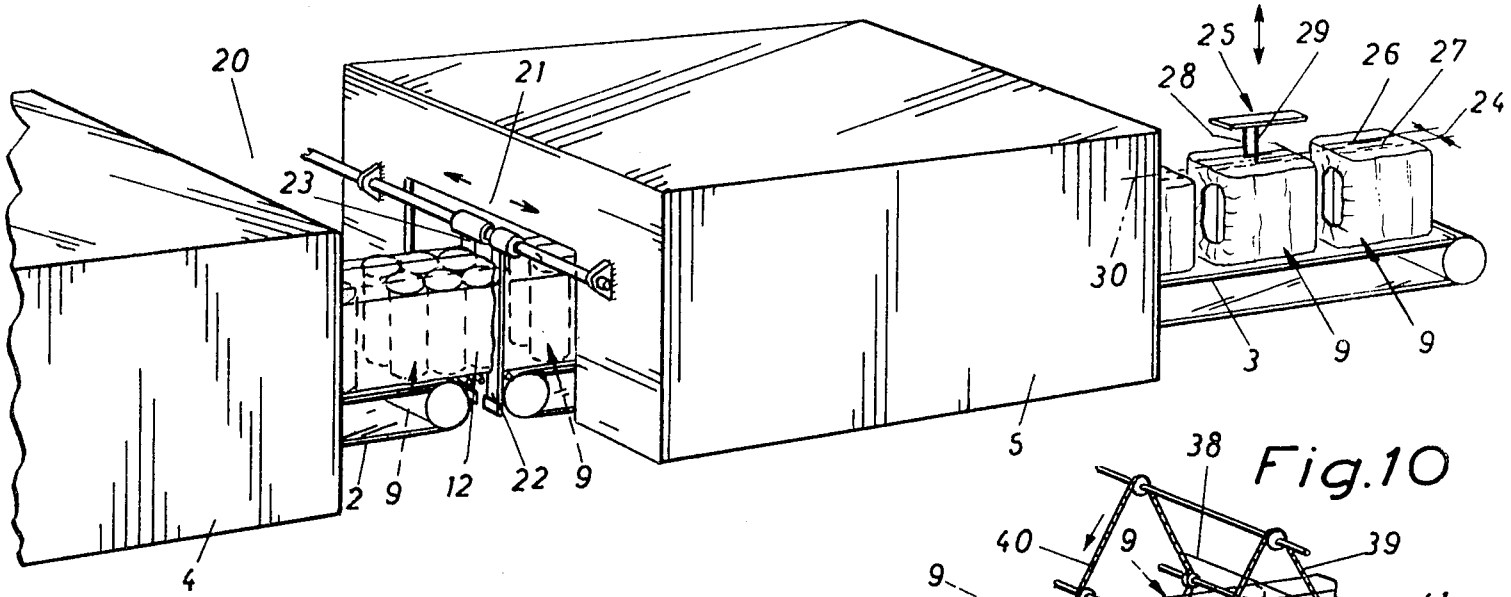
FIG. 2 is a view of the rear portion of said machine.

The packaging machine illustrated in FIGS. 1 and 2 comprises three conveyors 1, 2, and 3 and two shrinking tunnels 4 and 5 heated by hot air. On conveyor 1 are forwarded two rows of cans 6 up to a pair of alternatingly operative separating plates 7 and 8, forming an intermittently working means for separating the rows of cans into groups 9 each one of which comprising six cans. In the gap 10 between the conveyors 1 and 2 a web 12 of shrinking film is supplied from a supply roll 11 and fed up onto the conveyor 2, and the groups 9 of cans are fed onto said shrinking film web from the conveyor 1. By means of a device 13, 14 positioned above the conveyor 2 the longitudinal side edge portions 15 and 16 of the film web 12 are folded over the groups 9 of cans 6 in such a manner that the said edge portions 15 and 16 overlap, as appears from FIG. 4. Film portions 15, 16 are carried over a guide baffle 17 and heated by hot air supplied through a line 18, the portions 15, 16 being thus welded together. The film portions are then carried below a rotation roller 19 forcing them against the guide baffle 17. During the passage through the subsequent shrinking tunnel 4 the film 12 is pre-shrunk around the can groups 9, whereby the film is stretched around the cans. In the gap 20 between the shrinking tunnels 4 and 5 is located a device 21 for separating the film web 12 between two successive can groups 9. As illustrated in FIG. 2, this device may comprise two knives or chucks 22, 23 which are movable towards and away from each other and heated, preferably electrically, so as to be able to completely or partly melt the film web 12 between two can groups 9.

When the packages, having been thus separated from each other, have been forwarded on the conveyor 3 through the shrinking tunnel 5, and the film 12 of plastics shrunk around the respective can group 9 to the required extent, and the two side edge portions 15, 16, forming a reinforced section 24 of the package, been stretched somewhat as a result of the heat treatment, the packages arrive, one by one, up to a means 24 adapted to apply longitudinal slits or cuts 26, 27 in this reinforced package section 24. In accordance with the embodiment illustrated in FIG. 2, the means 25 comprises two preferably electrically heated wires 28, 29 which are bent in the direction of advancement of the conveyor 3, these wires being arranged, when operated by a mechanism not illustrated in the drawings, to move downwards into contact with the reinforced section 24 on either side of the longitudinal centre line 30 of said section (see FIGS. 2 and 3). The wires 28, 29 melt the material of the reinforced section 24, thus forming therein two lengthwise extending slits 26, 27 through which the fingers of a hand may be inserted to grip the strip 31 of the reinforced section 24, which strip is positioned between said slits and serve as a handle when the package is being carried. As appears particularly from FIG. 3, the ends of the strip 31 remain integral with the rest of the reinforced section, and because the strip 31 is made from a soft and flexible material the handle will willingly adapt itself to the configuration of the hand during carrying of the package.

Figure 8:
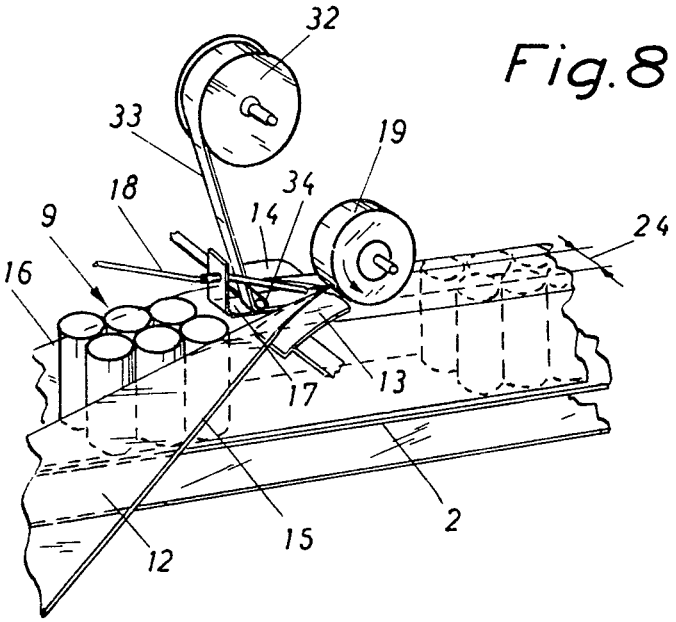
FIG. 8 is a perspective view of a part of the packaging machine, intended for the manufacture of the package according to FIG. 5.

When a stronger handle 31 is desired, the device illustrated in FIG. 8 may be used. From a supply roll 32 a strand 33 of polyethylene, tape, paper (if desired, laminated paper) or the like is carried over a deflector roll 34 and between the mutually facing surfaces of the two overlapping side edge portions 15, 16 of the film web 12 and is joined thereto as a result of pressure exerted by the roller 19 against the guide baffle 17 and, if needed, application of heat. As in the embodiment describe above, slits 26, 27 are made in the thus formed, reinforced section 24 by the wires 28, 29 to form the handle 31.

Figure 9:
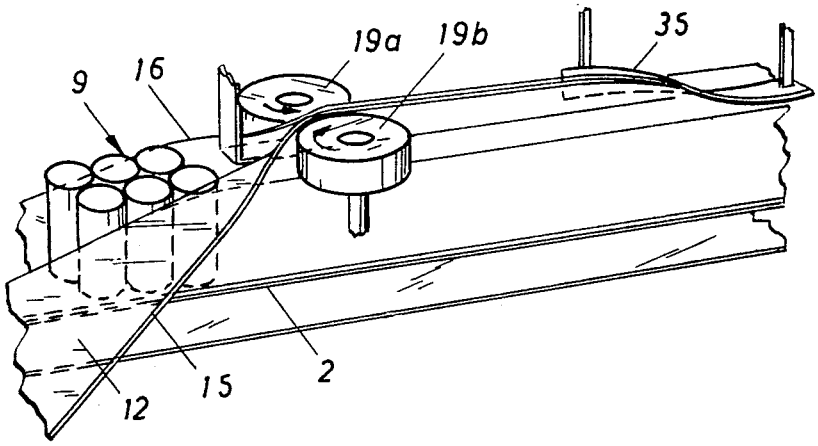
FIG. 9 is a perspective view of a part of a packaging machine intended for the manufacture of the package in accordance with FIGS. 6 and 7.

FIGS. 6 and 7 illustrate another manner in which to provide a reinforced section 24. In this instance the device illustrated in FIG. 9 is used. The two longitudinal side edge portions 15, 16 are pressed together and interconnected between two heated rotating rollers 19a and 19b and are thereby urged to assume a vertical position, as appears from FIG. 6. Folding means 35 are used to move the edge portions 15 and 16 downwards over the portion 36 of the film 12 being adjacent the edge portion 16 thereof and to interconnect portions 15, 16 with portion 36. In this case, the reinforced section 24 thus comprises three layers of the film 12 of plastics. In the manner described above, two longitudinal slits 26, 27 are made in the thus reinforced section.

Figure 10:
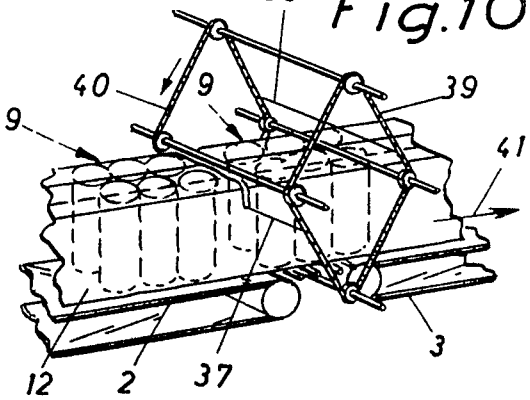
FIG. 10 is a perspective view of a portion of the packaging machine designed to separate individual packages from a series of packages, surrounded by shrinking film and having been discharged from the machine.

As described above and illustrated in FIG. 2, the device 21, intended to separate the film web 12, may comprise heated wires or chucks 22, 23. In FIG. 10 is illustrated another type of device for realizing this separation. This device comprises two heated threads 37 and 38 extending in the transverse direction of the machine, two parallel conveyor chains 39, 40 or the like directing this wires from above and obliquely downwards and forwards in the advancing direction of the conveyors 2, 3, indicated by arrow 41 in FIG. 10.

The embodiments as described and illustrated are to be regarded as examples only and the various parts of the machine may be constructively altered in a variety of ways within the scope of the appended claims. Instead of melting wires 28, 29 other means, such as cutting means, may be used to form the slits 26, 27. The latter need not necessarily be made in the reinforced section 24 itself but on either side thereof. The separation means 21 (FIG. 2) may be designed to effect only a weakening of the film web 12 between two successive groups 9 of packaging articles, if the conveyor 3 is driven at a somewhat higher speed than the conveyor 2, in which case the weakened film web portion thus formed will be torn. Instead of attaching the reinforcement strand or band 33 through welding by means of heat, an adhesive may be used. It is also possible to interconnect the longitudinal edge portions 15, 16 and the adjacent edge portions 36 (FIG. 7) of the film web 12 through glueing. The shrinking tunnel may be dispensed with.

What I claim is:

1. The method of manufacturing an article-enclosing package and carrier handle comprising the steps of arranging the articles in a desired packaging pattern, wrapping a film of shrinking type plastic around said articles, overlapping the longitudinal side edge portions of said film, heat sealing said overlapping side edge portions to form an elongate reinforced section of said package, and forming two longitudinal slits in said package in parallel relationship to the elongate reinforced section and on opposite sides thereof to form a strip integral with said reinforced section and suitable for use as a carrying handle, the longitudinal slits being formed of lesser length than the length of the reinforced section for transferring loads from the carrying handle to the remaining film through a portion of the reinforced section.

2. The method as set forth in claim 1 comprising the step of heating the film after the ends are heat sealed and before the slits are formed so as to shrink said film around the packaged articles and to stretch the reinforced section.

3. The method as set forth in claim 1 wherein the slits are formed by cutting the plastic by means of heated wires.

4. The method as set forth in claim 1 further including the step of forming an additional layer of plastic at said overlapping side portions, heat sealing said additional layers to said overlapping side edge portions, said two longitudinal slits being on opposite sides of the elongate reinforced section including said additional layers.

5. The method as set forth in claim 4 wherein the additional layer is formed by the step of folding the overlapping side portions against an adjacent portion of the film to form three film layers.

* * * * *